US012805636B2

(12) United States Patent
Lawson

(10) Patent No.: US 12,805,636 B2
(45) Date of Patent: Nov. 24, 2026

(54) GLIDER RECLINER MECHANISM AND CHAIR WITH INCREASED SEAT PITCH

(71) Applicant: L&P Property Management Company, South Gate, CA (US)

(72) Inventor: Gregory Mark Lawson, Tupelo, MS (US)

(73) Assignee: L&P Property Management Company, Carthage, MO (US)

( * ) Notice: Subject to any disclaimer, the term of this patent is extended or adjusted under 35 U.S.C. 154(b) by 162 days.

(21) Appl. No.: 18/744,936

(22) Filed: Jun. 17, 2024

(65) Prior Publication Data

US 2025/0380805 A1 Dec. 18, 2025

(51) Int. Cl.

| | |
|---|---|
| ***A47C 1/034*** | (2006.01) |
| ***A47C 1/035*** | (2006.01) |
| ***A47C 1/0355*** | (2013.01) |
| ***A47C 3/02*** | (2006.01) |
| ***A47C 3/025*** | (2006.01) |

(52) U.S. Cl.

CPC ..... *A47C 1/0345* (2013.01); *A47C 3/0255* (2013.01)

(58) Field of Classification Search

CPC ..... A47C 1/0345; A47C 3/0255

See application file for complete search history.

(56) References Cited

U.S. PATENT DOCUMENTS

| | | | | |
|---|---|---|---|---|
| 5,704,686 | A | 1/1998 | May | |
| 6,120,095 | A | 9/2000 | Rogers | |
| 7,997,644 | B2 * | 8/2011 | Hoffman | A47C 3/0255 297/344.21 |
| 8,016,348 | B2 * | 9/2011 | Hoffman | A47C 3/0255 297/85 M |
| 8,113,574 | B2 * | 2/2012 | Hoffman | A47C 3/18 297/85 L |
| 8,398,165 | B2 * | 3/2013 | Lawson | A47C 3/027 297/85 M |
| 8,398,168 | B2 * | 3/2013 | Lawson | A47C 1/0355 297/259.2 |
| 9,603,452 | B2 | 3/2017 | Murphy et al. | |
| 10,104,966 | B2 * | 10/2018 | Lawson | A47C 3/0255 |
| 10,653,243 | B2 * | 5/2020 | Lawson | A47C 1/03211 |
| 11,229,290 | B1 * | 1/2022 | Bryant | A47C 7/004 |
| 11,266,245 | B2 * | 3/2022 | Lawson | A47C 1/0355 |
| 2011/0175426 | A1 | 7/2011 | Lawson | |
| 2014/0049086 | A1 | 2/2014 | Pelletier et al. | |
| 2018/0027965 | A1 | 2/2018 | Lawson | |
| 2024/0130532 | A1 | 4/2024 | Li et al. | |
| 2025/0261757 | A1 * | 8/2025 | Crum | A47C 1/03211 |

OTHER PUBLICATIONS

International Search Report and Written Opinion received for PCT Patent Application No. PCT/US2025/033907, mailed on Aug. 27, 2025, 10 pages.

* cited by examiner

*Primary Examiner* — Rodney B White

(74) *Attorney, Agent, or Firm* — Shook, Hardy & Bacon L.L.P.

(57) ABSTRACT

A glider recliner mechanism is provided that allows a user to attain a zero-gravity fully reclined position, with a seat at an increased pitch. The glider recliner mechanism moves the seat forwardly as the recliner moves from a closed position to an extended position. The glider recliner mechanism pivots about a point lower and more rearward than previous mechanisms as the chair moves from the extended to the fully reclined position, allowing a lower center of gravity for the chair, and increased stability.

20 Claims, 10 Drawing Sheets

GLIDER RECLINER MECHANISM AND CHAIR WITH INCREASED SEAT PITCH

TECHNICAL FIELD

The present invention relates to the field of glider recliner chairs, and to a glider recliner chair mechanism for use on a glider chair that allows a gliding motion in the closed position and that allows an increased seat pitch in the fully reclined position while remaining stable.

BACKGROUND ART

Glider chairs are now a common furniture item. A glider chair allows a user to move the chair in a reciprocating, back-and-forth movement. Some of these glider chairs are operable to move the chair from a closed position, with the ottoman stowed below the chair and the back generally upright, to an extended or TV position, with the ottoman extended in front of the seat of the chair, with the back remaining generally upright, to a fully reclined position, with the ottoman extended and with the chair back reclined.

Other recliners are now offering a fully reclined position with the seat (and the chair generally) in an increased reclined position. These chairs are sometimes referred to as zero-gravity chairs in that the user is reclined at a greater angle in the fully reclined position than other recliner chairs. It would be desirable to offer this type of fully reclined position in a glider chair. However, in the existing glider chairs, moving the chair to a zero-gravity position can compromise the stability of the chair, and could even create a tipping condition.

BRIEF SUMMARY OF THE INVENTION

Embodiments of the invention are defined by the claims below, not this summary. A high-level overview of various aspects of the invention are provided here for that reason, to provide an overview of the disclosure, and to introduce a selection of concepts that are further described below in the detailed-description section. This summary is not intended to identify key features or essential features of the claimed subject matter, nor is it intended to be used as an aid in isolation to determine the scope of the claimed subject matter.

This disclosure relates to a glider recliner mechanism, and a chair using such a mechanism. The glider recliner mechanism can be used on a chair with gliding functionality, and that can be moved between a closed position, and extended position, and a fully reclined zero-gravity position (where the back recline and seat pitch increases to allow for user comfort). In moving to the extended position, the glider recliner mechanism moves the seat forward and down, to increase the stability of the chair when it moves to the fully reclined zero gravity position. In moving from the extended position to the fully reclined zero-gravity position, the glider recliner mechanism also pivots about a point that is lower and rearward of other mechanisms, again resulting in a more stable chair and lessening the chances of a tipping condition.

BRIEF DESCRIPTION OF THE SEVERAL VIEWS OF THE DRAWING

The above and other features and advantages of the present invention will become more readily appreciated from the following description of the accompanying drawings, in which.

DETAILED DESCRIPTION OF THE INVENTION

The subject matter of embodiments of the invention is described with specificity herein to meet statutory requirements. But the description itself is not intended to necessarily limit the scope of claims. Rather, the claimed subject matter might be embodied in other ways to include different steps, components, or combinations thereof, in conjunction with other present or future technologies.

The present invention is described in further detail below with reference to the drawings and the embodiments. Terms such as "first", "second", and the like are used hereinafter to describe elements of the present application, but they are only used to distinguish the elements, and are not intended to limit the nature, sequence, order, or number of the elements. In addition, any reference to orientation such as "up/down", "front/rear" and "left/right" that may be used in the following description refers to the direction or orientation of the glider recliner mechanism in a glider recliner chair relative to a user seated on the chair. Unless otherwise stated, these orientation terms are only used for convenience of description and are not intended to limit the technical solution of the invention in any way. Furthermore, it should be noted that in the present specification, identical and/or functionally identical technical features are marked by the same or similar reference signs.

Figure 1:
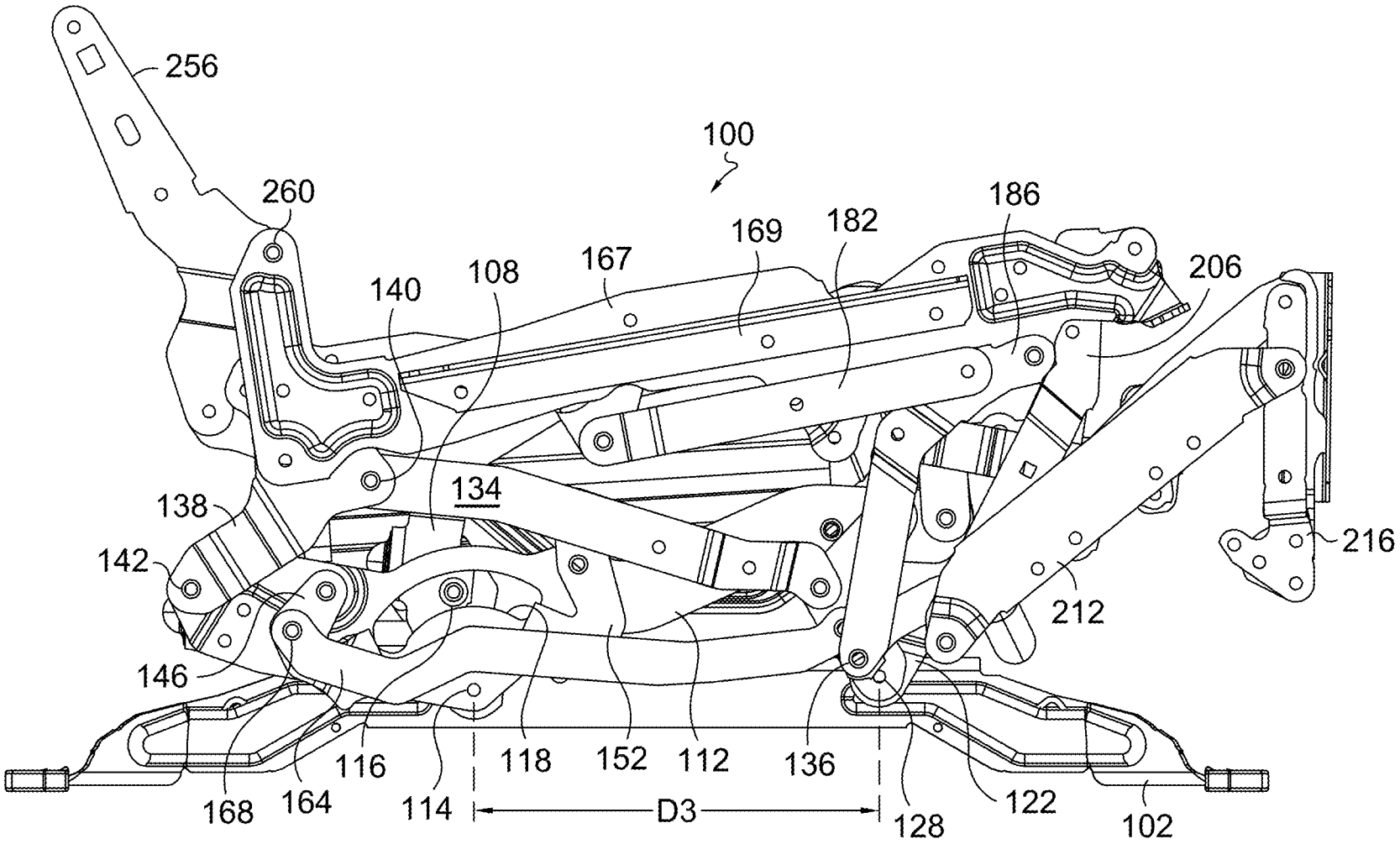
FIG. 1 illustrates a side view of a glider recliner mechanism for a glider chair, in the closed position, according to an aspect of this disclosure.
Figure 2:
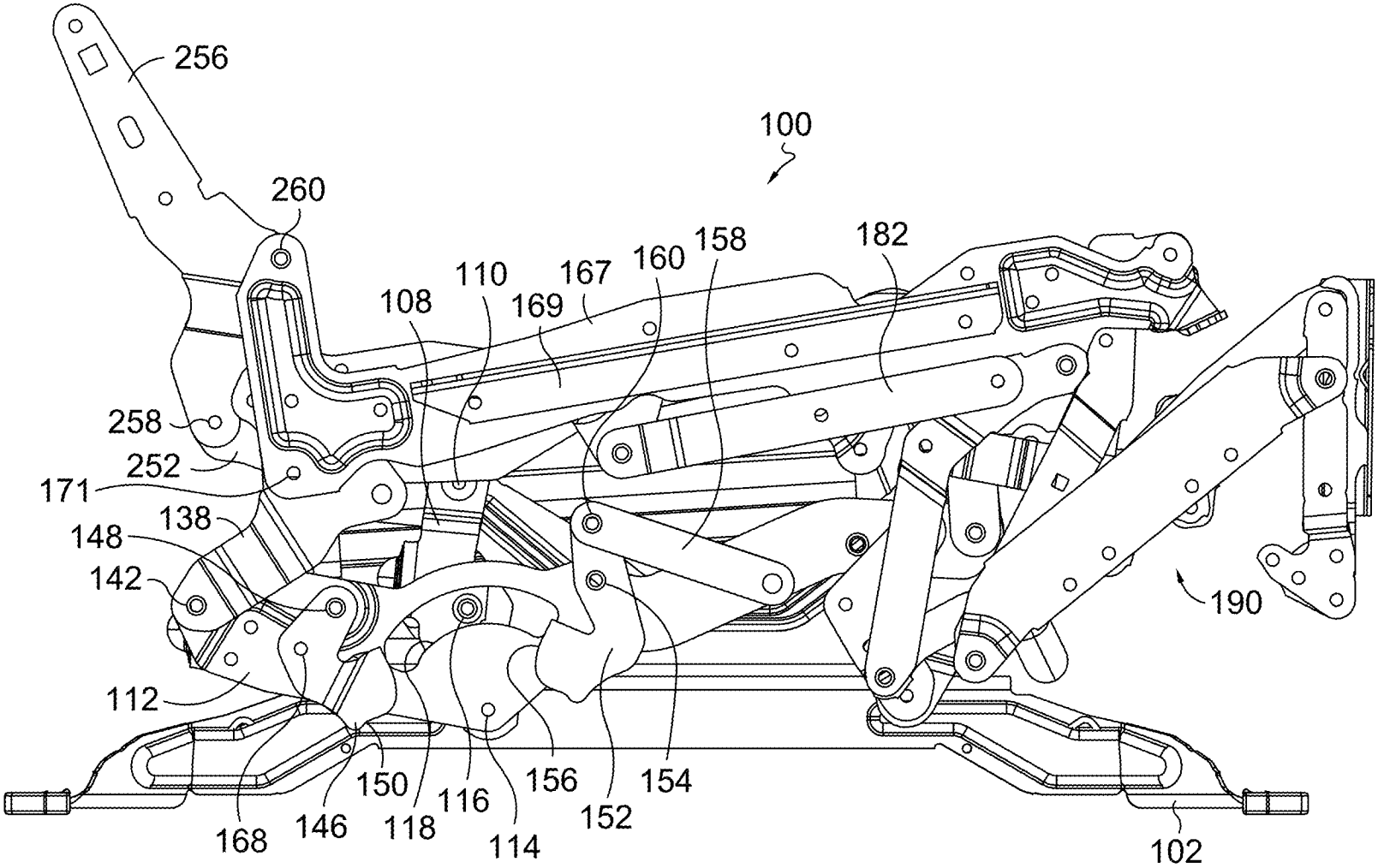
FIG. 2 is a view similar to FIG. 1, but with some components hidden to show other links more clearly.
Figure 3:
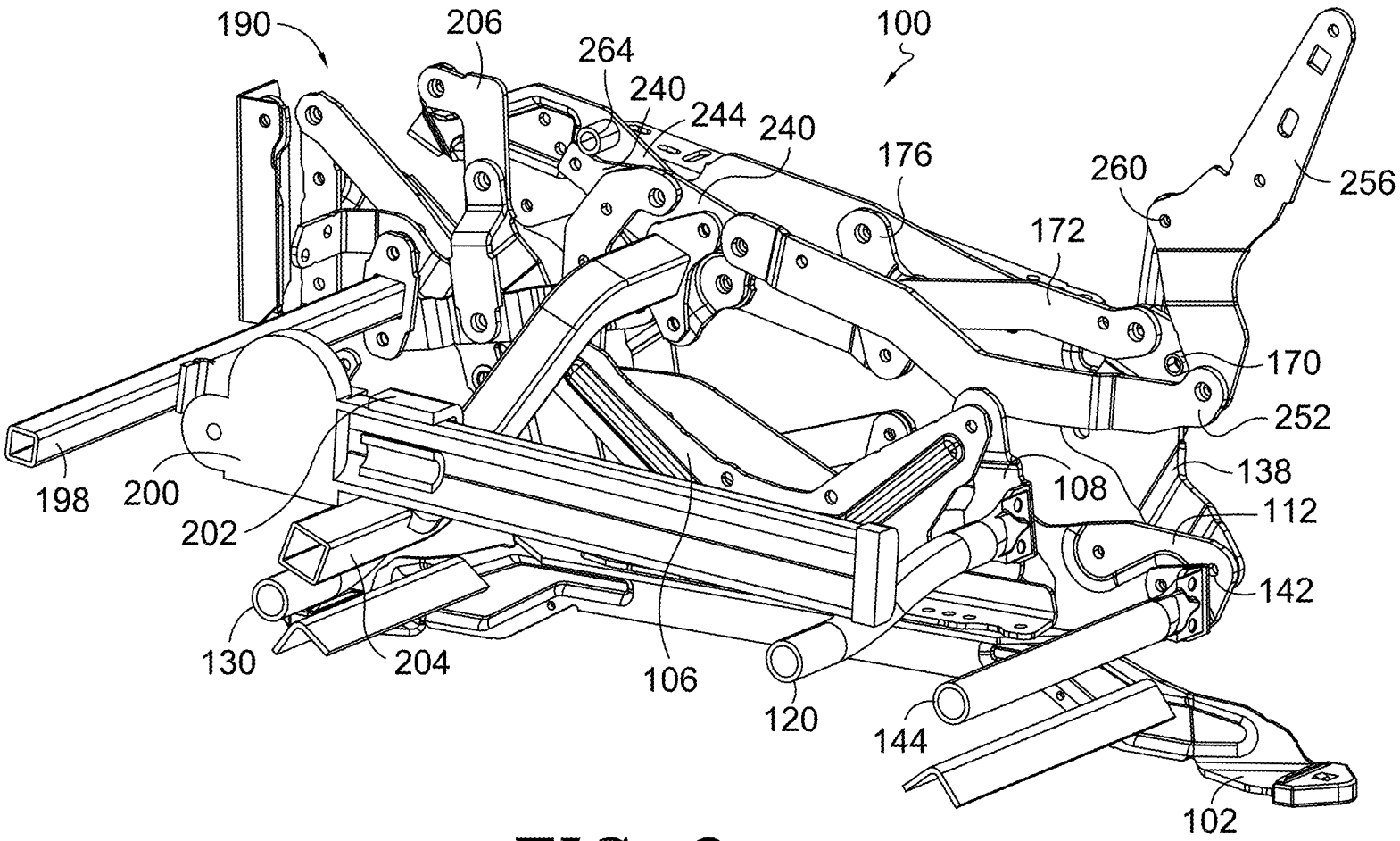
FIG. 3 is a perspective, cross sectional view of the mechanism of FIG. 1.

FIGS. 1-3 illustrate a glider recliner mechanism 100 in a closed position. In the closed position, the glider recliner mechanism 100 allows a user of a chair, with the glider recliner mechanism 100, to glide back and forth (with the seat and back reciprocating forward and backward). The glider recliner mechanism 100 also allows the chair to move to an extended or "TV" position, as shown in FIGS. 4-7, with the ottoman extended in front of the seat, and with the back generally upright. In the extended position, the glider recliner mechanism 100 prevents the gliding motion. Further, in the extended position the glider recliner mechanism 100 moves the seat forwardly, with a new glide geometry to compensate for the forward weight transfer in the extended position. The glider recliner mechanism 100 also allows the chair to move to a fully reclined position, as shown in FIGS. 8-9, with an increased back recline and seat pitch, to provide a "zero-gravity" type position. The glider recliner mechanism 100 rotates about a point when transitioning from the extended position to the fully reclined position that is lower and more rearward than in other mechanisms. In this way, the chair on which the glider recliner mechanism 100 is used is more stable in the zero-gravity, fully reclined position.

Figure 6:
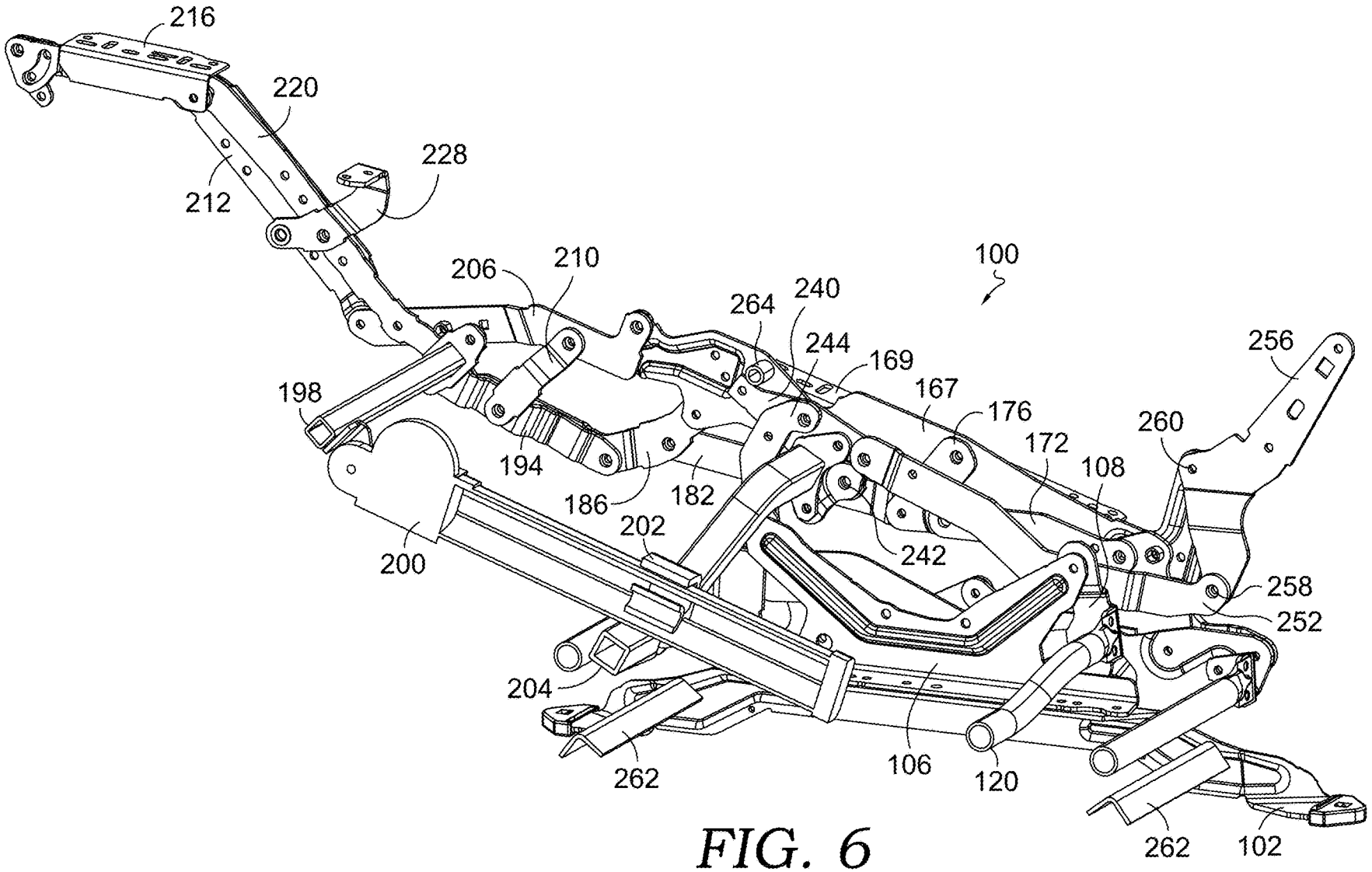
FIG. 6 is a perspective, cross sectional view of the mechanism of FIG. 4.
Figure 7:
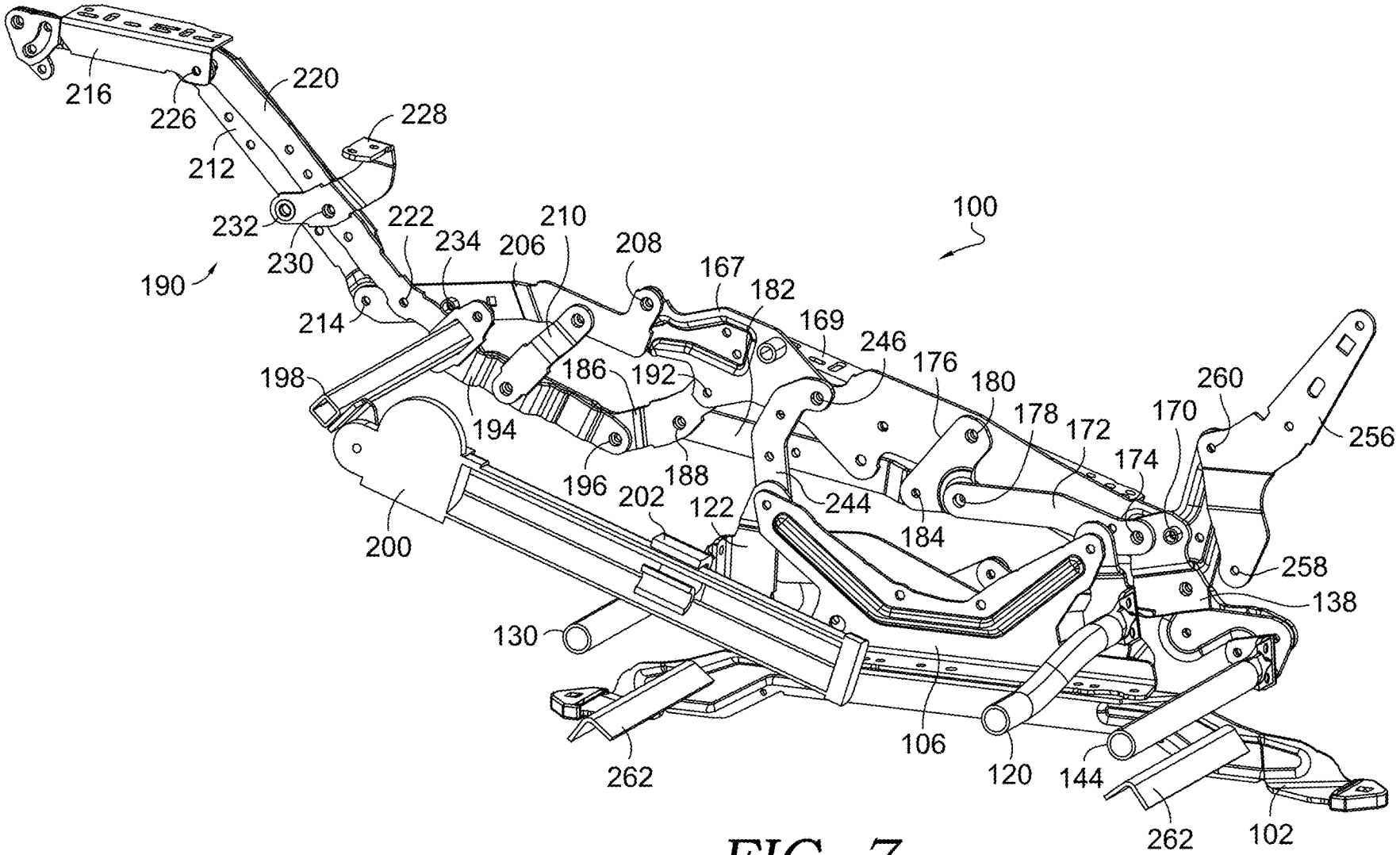
FIG. 7 is a view similar to FIG. 6, but with some components hidden to show other links more clearly.
Figure 8:
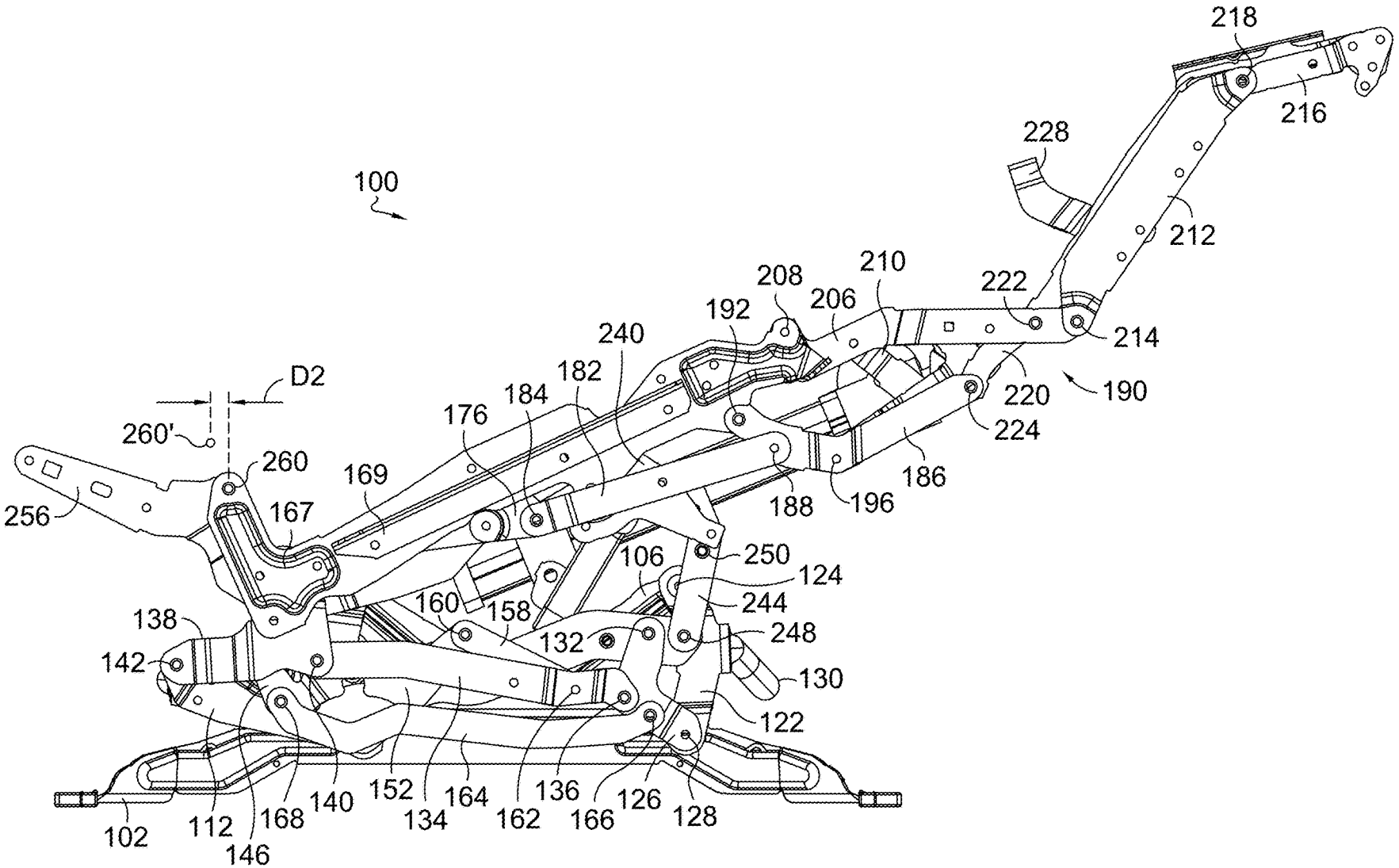
FIG. 8 illustrates a side view of a glider recliner mechanism for a glider chair, in a fully reclined position, according to an aspect of this disclosure.
Figure 9:
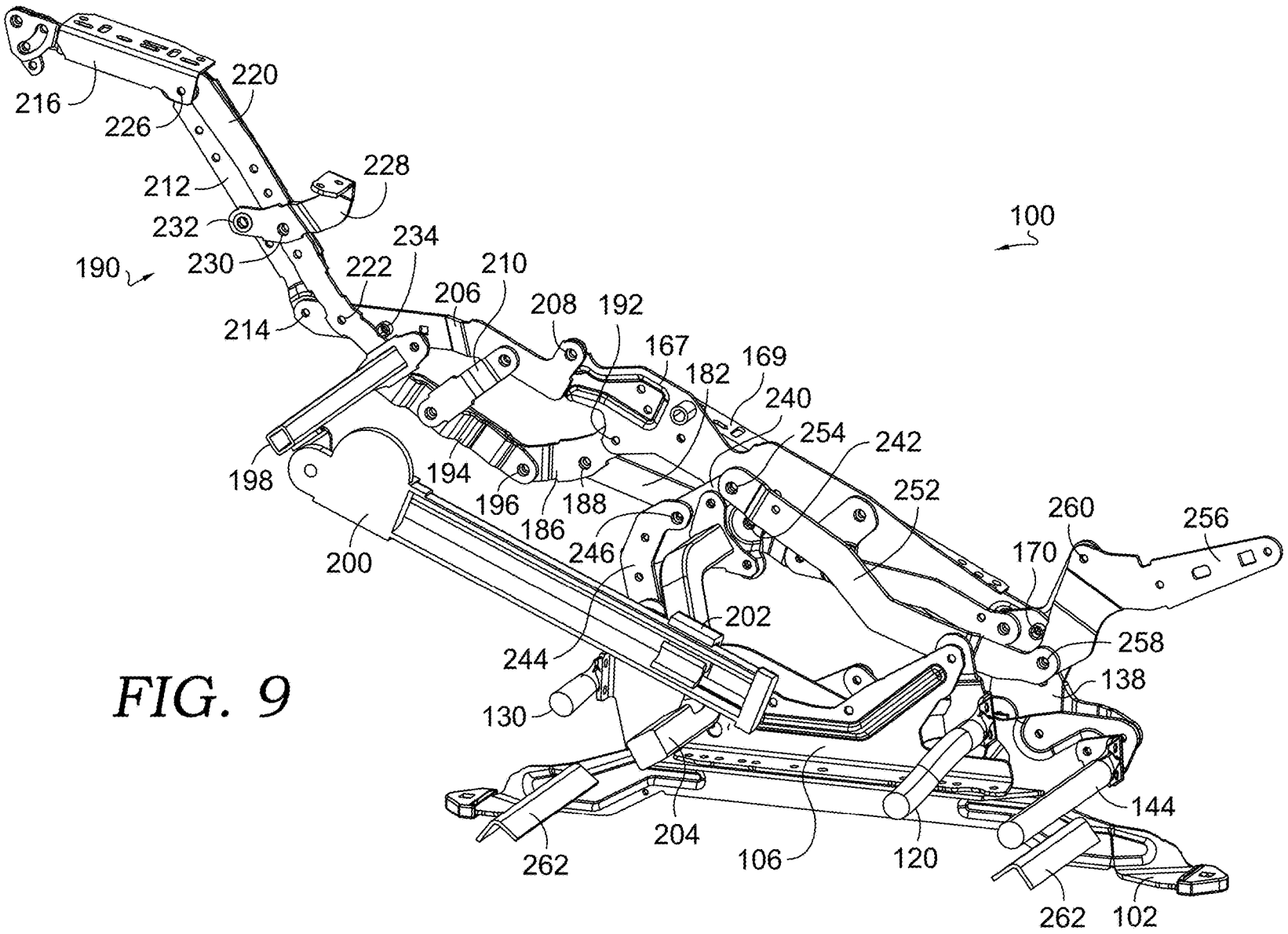
FIG. 9 is a perspective, cross sectional view of the mechanism of FIG. 8.
Figure 10:
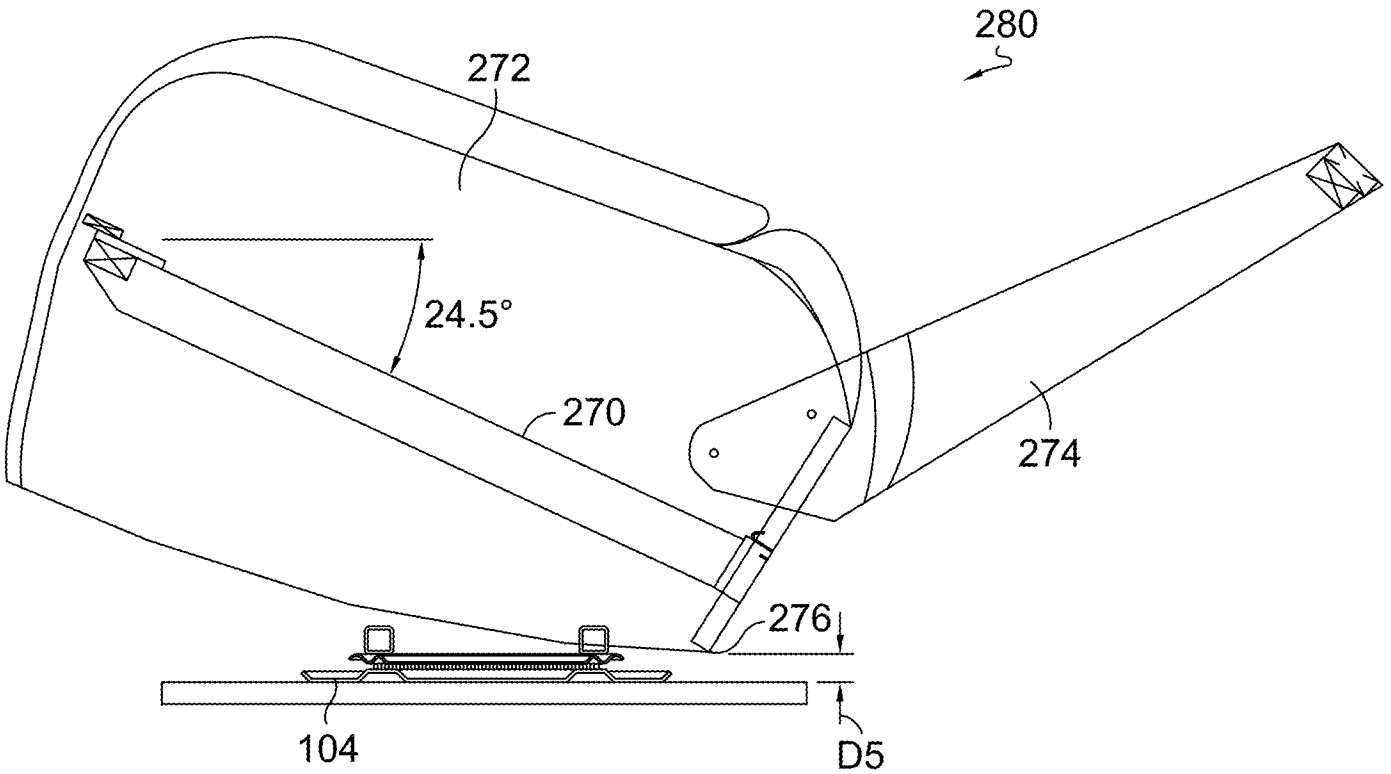
FIG. 10 is a schematic view of a glider chair, on a swivel base (without showing the ottoman and ottoman linkage), and showing the seat, back and arms in the fully reclined position.

As shown in FIGS. 1-9, the glider recliner mechanism 100 may include a pair of spaced apart base rails 102. In other aspects, as shown in FIG. 10, the glider recliner mechanism 100 may be mounted on a swivel base 104. As best seen in FIG. 6, a glide bracket 106 is fixedly mounted to a corresponding base rail 102 and projects upwardly from the base rail 102. The glider recliner mechanism 100 has two spaced apart sides, which are mirror images of one another. This disclosure will discuss one side of the glider recliner mechanism 100 for purposes of brevity. As best seen in FIG. 2 (with some links hidden as discussed below), a rear glide link 108 is pivotally coupled to the rearward end of the glide bracket 106, at pivot point 110. The lower end of the rear glide link 108 is pivotally coupled to a carrier link 112 at pivot point 114. Generally midway between pivot points 110 and 114, the rear glide link 108 includes an outwardly extending pin 116. As the rear glide link 108 moves, or swings, forward and backward (allowing the gliding motion), the pin 116 travels within an arced slot 118 formed in the carrier link 112. As seen in FIG. 3, the rear glide links 108 may be coupled to one another via a rear support tube 120.

As best seen in FIG. 8, a front glide link 122 is pivotally coupled to the forward end of the glide bracket 106, at pivot point 124. Rather than the lower end of the front glide link 122 being coupled to the carrier link, as in existing glider mechanisms, the lower end of the front glide link 122 is pivotally coupled to a glide pivot link 126 at pivot point 128. As with the rear glide links 108, the front glide links 122 may be coupled to one another via a front support tube 130, as best seen in FIG. 9. Returning to FIG. 8, the upper end of the glide pivot link 126 is pivotally coupled to the carrier link 112 at pivot point 132. The glide pivot link 126 has a slight bend between pivot points 128 and 132. At this bend, the glide pivot link 126 is pivotally coupled to a glide control link 134 at pivot point 136. The glide control link 134 extends rearward from pivot point 136, and is pivotally coupled at its opposite end to a rear pivot link 138, at pivot point 140. The rear pivot link 138 is also pivotally coupled to the carrier link 112 at pivot point 142. As seen in FIG. 3, the carrier links 112 may be coupled to one another with a cross tube 144, near pivot point 142.

As best seen in FIG. 2, a rear blocker cam 146 is pivotally coupled to the carrier link 112 at pivot point 148. Opposite pivot point 148, the rear cam 146 has a cam surface 150, the importance of which is described further below. Similarly, a front blocker cam 152 is pivotally coupled to the carrier link 112 at pivot point 154. Like the rear cam 146, the front cam 152 has a cam surface 156. Additionally, the front cam 152 extends beyond pivot point 154, and is pivotally coupled to a cam link 158, at pivot point 160. Returning to FIG. 8, the end of the cam link 158 opposite pivot point 160 is pivotally coupled to the glide control link 134 at pivot point 162. The glide pivot link 126 is also pivotally coupled to a rear cam control link 164 at pivot point 166. The other end of the rear cam control link 164 is pivotally coupled to the rear cam 146 at pivot point 168.

As the glider recliner mechanism 100 moves from the closed position of FIGS. 1-3, to the extended position of FIGS. 4-7, the glide pivot link 126 rotates about pivot point 132, and moves pivot point 128 forwardly (counter clockwise as viewed in the figures). This motion pulls the cam link 158 forwardly, rotating the front cam 152 about pivot point 154 (from the position shown in FIG. 2, to the position shown in FIG. 5. As the front cam 152 rotates the cam surface 156 acts upon the pin 116 to move it toward the center of the arced slot 118. Similarly, as the glide pivot link 126 rotates, it pulls the rear cam control link 164 forwardly, rotating the rear cam 146 about pivot point 148 (from the position shown in FIG. 2, to the position shown in FIG. 5). As the rear cam 146 rotates, the cam surface 150 acts upon the pin 116 to move it toward the center of the arced slot 118. Both the front cam 152 and the rear cam 146 act to move the pin 116 (and thus the rear glide link 108) to the middle of the arced slot 118, no matter what position the rear glide link 108 was in as the glider recliner mechanism 100 moves to the extended position. Once in the position shown in FIG. 5, the pin 116 is held in place by the front cam 152 and the rear cam 146, preventing the rear glide link 108 from moving forward or rearward (thus preventing any glide motion).

As seen in FIG. 2, the rear pivot link 138 is pivotally coupled to a seat plate 167 at pivot point 171. The seat plate 167 is used to mount a seat of the chair, such as through a seat bracket 169. As best seen in FIG. 7, the rear pivot link 138 may also include, in some aspects, a fixed pin 170 that extends inwardly from the rear pivot link 138. With continued reference to FIG. 7, a rear footrest drive link 172 is pivotally coupled to the rear pivot link 138 at pivot point 174. The other end of the rear footrest drive link 172 is pivotally coupled to a center bell crank 176 at pivot point 178. The center bell crank 176 is also pivotally coupled to the seat plate 167 at pivot point 180. The center bell crank 176 couples the rear footrest drive link 172 to a front footrest drive link 182. More specifically, the front footrest drive link 182 is pivotally coupled to the center bell crank 176 at pivot point 184, as seen in FIGS. 7 and 8. The opposite end of the front footrest drive link 182 is pivotally coupled to a rear ottoman link 186 at pivot point 188. The linkage of the rear footrest drive link 182, the center bell crank 176, and the front footrest drive link 182 allows the coupling of the rear pivot link 138 to the rear ottoman link 186, and transitions from inside the seat plate 167 (the rear footrest drive link 182) to outside the seat plate 167 (the front footrest drive link 182).

The rear ottoman link 186 is one link in an ottoman linkage 190 that moves an ottoman from a closed position stowed below the seat, to an extended or TV position with the ottoman extended in front of the seat. The rear ottoman link 186 is pivotally coupled to the seat plate 167 at pivot point 192. As best seen in FIG. 7, a bracket 194 is pivotally coupled to the rear ottoman link 186 at pivot point 196. The end of the bracket 194 opposite pivot point 196 is fixedly coupled to a front motor tube 198. A motor 200 (shown in section in FIG. 9) is pivotally coupled to the front motor tube 198 on one end. As best seen in FIG. 6, the motor 200 drives a block 202 that is pivotally coupled to a rear motor tube 204. Returning to the ottoman linkage 190, a front ottoman link 206 is pivotally coupled to the seat plate 167 at pivot point 208. As shown in FIG. 9, a connector 210 is pivotally coupled on one end to the rear ottoman link 186 and on the other end to the front ottoman link 206. The end of the front ottoman link 206 opposite pivot point 208 is pivotally coupled to a wide ottoman link 212 at pivot point 214 (see FIG. 8). The end of the wide ottoman link 212 opposite pivot point 212 is pivotally coupled to a main ottoman bracket 216 at pivot point 218. The front ottoman link 206 is also pivotally coupled to a main ottoman link 220 at pivot point 222. As seen in FIG. 8, the main ottoman link 220 is pivotally coupled on one end to the rear ottoman link 186 at pivot point 224. As seen in FIG. 9, the other end of the main ottoman link 220 is pivotally coupled to the main ottoman bracket 216 at pivot point 226. The ottoman linkage 190 also includes, in some aspects, a mid-ottoman bracket 228 that is pivotally coupled to the main ottoman link 220 at pivot point 230 and pivotally coupled to the wide ottoman link 212 at pivot point 232. As seen in FIG. 9, in some aspects, the front ottoman link 206 includes a stop pin 234 that extends inwardly. The stop pin 234 abuts the main ottoman link 220 when the ottoman linkage 190 is in the extended position.

As best seen in FIG. 9, the rear motor tube 204 is fixedly coupled to a front lift link 240. The motor tube 204 thus extends between opposing front lift links 240. The front lift link 240 is pivotally coupled to the seat plate 167 at pivot point 242, and activation of the motor 200 will rotate the front lift link 240 about pivot point 242 as the glider recliner mechanism 100 moves from the extended position to the fully reclined position. As seen in FIG. 9, a front pivot link 244 is pivotally coupled to the front lift link 240 at pivot point 246. As seen in FIG. 8, the other end of the front pivot link 244 is pivotally coupled to the carrier link 112 at pivot point 248. In some aspects, the front pivot link 244 includes a stop pin 250. The front lift link 240 may include an outwardly extending lobe that abuts the stop pin 250 when the glider recliner mechanism 100 is moved to the fully reclined position, adding stability to the linkage in the fully reclined position. Returning to FIG. 9, a back drive link 252 is pivotally coupled to the front lift link 240 at pivot point 254. The other end of the back drive link 252 is pivotally coupled to a back bracket 256 at pivot point 258. The back bracket 256 is pivotally coupled to the seat plate 167 at pivot point 260. In the fully reclined position, as seen in FIG. 9, the back bracket 256 abuts the pin 170 on the rear pivot link 138. The pin 170 also adds stability in the fully reclined position, and assists in rotating the back bracket 256 from the fully reclined position to the extended position. In some aspects, the base rails 102 may be coupled to one another through one or more cross-supports 262. In some aspects, as seen in FIG. 3, a stop pin 264 may be coupled to the seat plate 167. The stop pin 264 extends inwardly and abuts a portion of the front lift link 240 in the closed position and the extended position to keep the links of the glider recliner mechanism 100 tightly in position.

Figure 4:
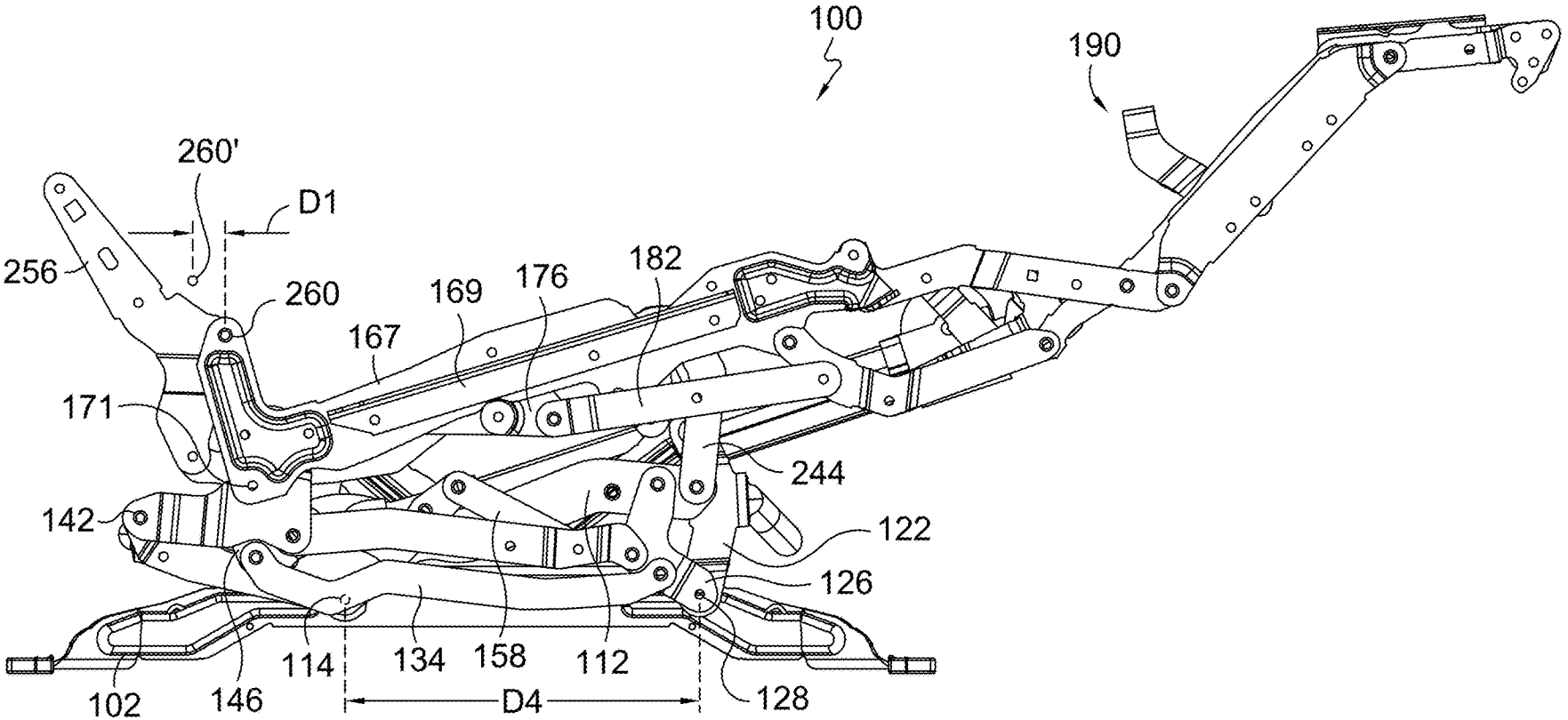
FIG. 4 illustrates a side view of a glider recliner mechanism for a glider chair, in an extended position, according to an aspect of this disclosure.
Figure 5:
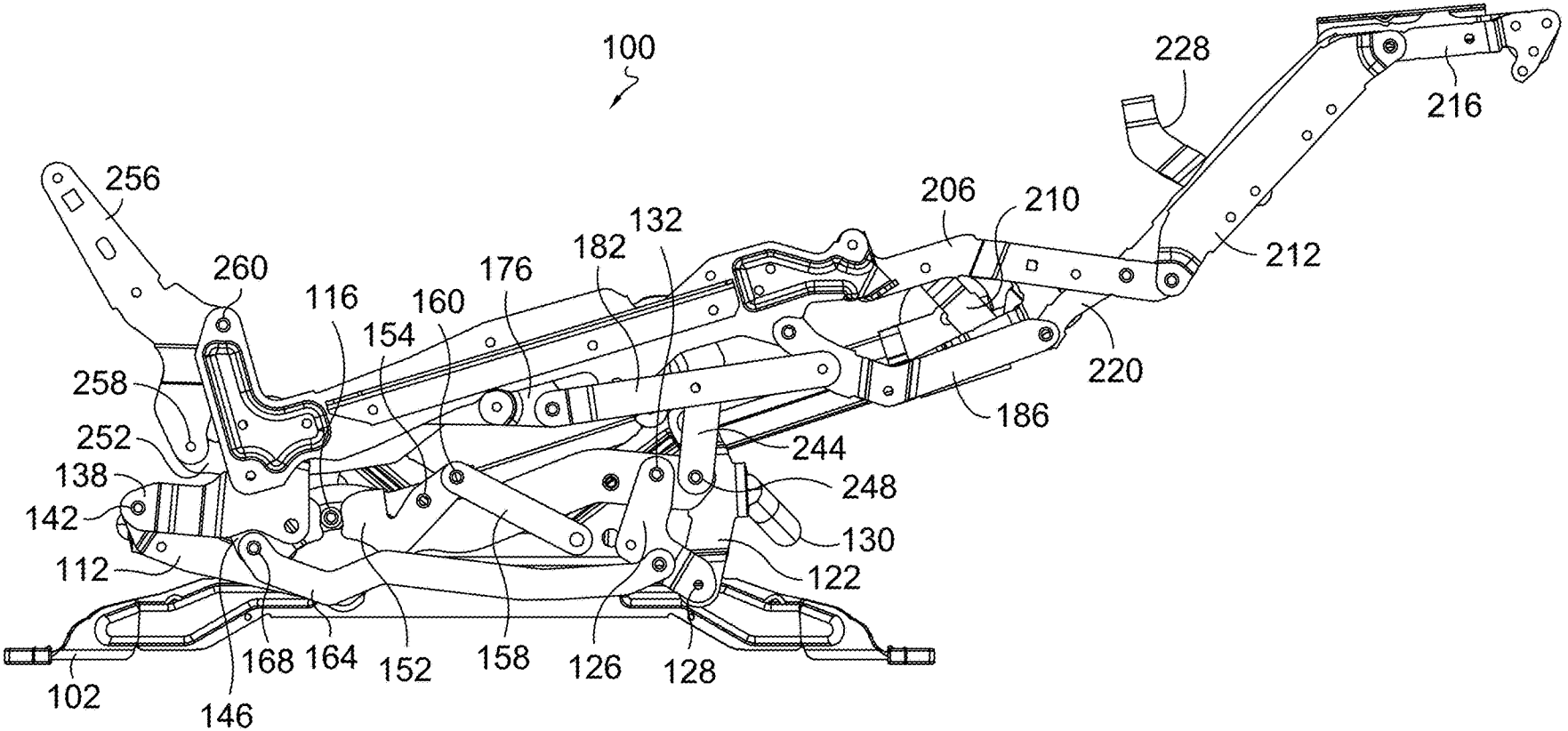
FIG. 5 is a view similar to FIG. 4, but with some components hidden to show other links more clearly.

As the glider recliner mechanism 100 moves from the closed position of FIG. 1 to the extended position of FIG. 4, the rear pivot link 138 rotates forwardly (clockwise about pivot point 142 as viewed in FIGS. 1 and 4). This rotation of the rear pivot link 138 moves the seat plate 167 down and forwardly a distance labeled D1 in FIG. 4. (In FIG. 4, from 260' which is the location of pivot point 260 in the closed position, to 260 which is the location of pivot point 260 in the extended position). This moves the center of gravity lower and forward in the extended position of FIG. 4. As the glider recliner mechanism 100 moves from the extended position of FIG. 4 to the fully reclined, zero gravity position of FIG. 8, the seat plate 167 moves slightly rearward, but stays forward of the closed position (in FIG. 8, pivot point 260 in the fully reclined position stays forward and below pivot point 260' which is the location of pivot point 260 in the closed position). To allow this forward movement, the front glide link 122 is not directly coupled to the carrier link 112 (as is the case in other glider recliner mechanisms). Instead, the front glide link 122 is coupled to the glide pivot link 126, which is in turn coupled to the carrier link 112. This allows the lower end of the front glide link 122 to move forward when the glider recliner mechanism 100 moves from the closed position of FIG. 1 to the extended position of FIG. 4. This allows the lower end of the front glide link 122 to move away from the lower end of the rear glide link 108. In other words, the distance D3 labeled in FIG. 1 (from pivot point 114 to pivot point 128) is less than the distance D4 labeled in FIG. 4 (from pivot point 114 to pivot point 128).

When moving from the extended position of FIG. 6, to the fully reclined zero-gravity position of FIG. 9, the motor 200 moves the motor block 202 rearward, causing the front lift link 240 to rotate about pivot point 242 on the seat plate 167 (counter clockwise as viewed in FIGS. 6 and 9). Pivot point 142 serves as a recline pivot point, and, in some aspects, is below and behind the back of the seat plate 167. This motion pushes down on the front pivot link 244 and increases the pitch or angle of the seat plate 167 up by raising pivot point 242. This rotation also reclines the back bracket 256 through the connection of the front lift link 240 to the back bracket 256 via the back drive link 252. The seat (carried by the seat plate 167 and seat bracket 169) and the back (carried by the back bracket 256) rotate about pivot point 142 as the glider recliner mechanism 100 moves from the extended position to the fully reclined zero-gravity position. Pivot point 142 is located rearward and below a comparable pivot point on existing mechanisms.

FIG. 10 schematically shows a chair 280 incorporating glider recliner mechanism 100. The chair 280 includes a swivel base 104, the glider recliner mechanism 100 (which would be in the position shown in FIG. 9), arms 272, a back 274 (coupled to the back bracket 256), and a seat 270 (coupled to the seat bracket 169 and the seat plate 167). The ottoman is not shown in FIG. 10, but it would project in front of the seat in the orientation shown in FIG. 9. As shown, the glider recliner mechanism 100 is operable to move the seat 270 and the back 274, in the fully reclined position, to an orientation with an increased pitch. As shown in FIG. 10, the seat 270, in some aspects, achieves an angle of 24.5 degrees. It should be understood that the angle or pitch of the seat 270 could be adjusted to a range around 24.5 degrees, such as between about 21 and 27 degrees. As also shown in FIG. 10, the arm 272 may have a lower rear corner identified as 276. By moving the seat 270 forwardly, and by rotating the glider recliner mechanism 100 about pivot point 142, as described above, the distance D5 of the lower rear corner 276 of the arm 270 is moved forwardly, and lower than on existing mechanisms and chairs. In some aspects, the distance D5 can be as low as around one inch from the surface on which the chair 280 rests. This is in contrast to existing mechanism where the comparable distance D5 is over 3.5 inches. In some aspects, the distance D5 for the chair 280 using the glider recliner mechanism 100 is in a range of about one to one and a half inches.

CLAUSES

In addition to the claims at the end of this specification, the following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1: A glider recliner mechanism for use on a chair, the glider recliner mechanism comprising: a base; a glide bracket coupled to the base; a front glide link having an upper end and a lower end, the upper end of the front glide link being pivotally coupled to the glide bracket; a rear glide link having an upper end and a lower end, the upper end of the front glide link being pivotally coupled to the glide bracket; a recline mechanism having a plurality of interconnected links, the recline mechanism coupled to the lower end of the front glide link and the rear glide link; a back bracket coupled to the recline mechanism; a seat plate coupled to the recline mechanism; an ottoman linkage coupled to the recline mechanism; the recline mechanism operable to move the glider recliner mechanism from a closed position, with the ottoman linkage stowed, to an extended position with the ottoman linkage extended in front of the seat plate, and to a fully reclined position with the ottoman linkage extended in front of the seat plate, the seat plate reclined from front to back and the back bracket reclined from an upright position; wherein the interconnected links of the recline mechanism move the lower end of the front glide link forwardly as the recline mechanism moves the glider recliner mechanism from the closed position to the extended position.

Clause 2: The glider recliner mechanism of clause 1, wherein the interconnected links of the recliner mechanism further comprise a carrier link, and wherein the lower end of the rear glide link is directly, pivotally coupled to the carrier link, and the lower end of the front glide link is indirectly, pivotally coupled to the carrier link.

Clause 3: The glider recliner mechanism of any of clauses 1 and 2, wherein the interconnected links of the recliner mechanism further comprise a glide pivot link pivotally coupled between the carrier link and the front glide link.

Clause 4: The glider recliner mechanism of any of clauses 1-3, wherein the interconnected links of the recliner mechanism further comprise: a rear pivot link pivotally coupled to the carrier link and the seat plate; and a glide control link pivotally coupled to the rear pivot link on one end, and pivotally coupled to the glide pivot link on the other end; wherein the rear pivot link rotates forwardly as the recline mechanism moves the glider recliner mechanism from the closed position to the extended position.

Clause 5: The glider recliner mechanism of any of clauses 1-4, wherein the forward rotation of the rear pivot link translates the glide control link forwardly, moving the lower end of the front glide link forwardly, as the recline mechanism moves the glider recliner mechanism from the closed position to the extended position.

Clause 6: The glider recliner mechanism of any of clauses 1-5, wherein the forward rotation of the rear pivot link translates the seat plate forwardly as the recline mechanism moves the glider recliner mechanism from the closed position to the extended position.

Clause 7: The glider recliner mechanism of any of clauses 1-6, wherein the seat plate, the back bracket and the ottoman linkage rotate about the pivot point between the rear pivot link and the carrier link as the glider mechanism moves from the extended position to the fully reclined position.

Clause 8: The glider recliner mechanism of any of clauses 1-7, wherein the pivot point between the rear pivot link and the carrier link is located below and behind the lower corner of the seat plate.

Clause 9: The glider recliner mechanism of any of clauses 1-8, wherein the lower end of the front glide link and the lower end of the rear glide link are a first distance apart with the glider recliner mechanism in the closed position, and wherein the lower end of the front glide link and the lower end of the rear glide link are a second distance apart with the glider recliner mechanism in the extended position, and wherein the second distance is greater than the first distance.

Clause 10: The glider recliner mechanism of any of clauses 1-9, further comprising an inwardly extending stop pin fixedly coupled to the rear pivot link, wherein a lower portion of the back bracket abuts the stop pin when the glider recliner mechanism is in the fully reclined position.

Clause 11: A glider recliner chair, comprising: a base; a glider recliner mechanism coupled to the base; a seat coupled to the glider recliner mechanism; a back coupled to the glider recliner mechanism; an ottoman coupled to the glider recliner mechanism; a pair of spaced apart arms coupled to the glider recliner mechanism; the glider recliner mechanism operable to allow a gliding reciprocal motion of the seat with the chair in a closed position with the ottoman linkage stowed below the seat and the back generally upright, and operable to move the glider recliner chair from the closed position to an extended position with the ottoman extended in front of the seat and the back generally upright, and to a fully reclined position with the ottoman extended in front of the seat, the seat reclined from front to back and the back reclined from an upright position; and wherein the glider mechanism rotates the glider recliner chair about a recline pivot point located below and behind the back of the seat as the glider recliner chair moves from the extended position to the fully reclined position.

Clause 12: The glider recliner chair of clause 11, wherein the recline pivot point allows the lower, rearward most portion of each chair arm to be within one and one-half inches of the underlying support surface on which the glider recliner rests, when the glider recliner is moved to the fully reclined position.

Clause 13: The glider recliner chair of any of clauses 11-12, wherein the seat, in the fully reclined position, is reclined at an angle above twenty degrees, relative to horizontal.

Clause 14: The glider recliner chair of any of clauses 11-13, wherein the glider recliner mechanism moves the seat forwardly as the recliner chair moves from the closed position to the extended position.

Clause 15: The glider recliner chair of any of clauses 11-14, wherein the glider recliner mechanism prevents the gliding reciprocal motion in the extended position and the fully reclined position.

Clause 16: A glider recliner mechanism for use on a chair, the glider recliner mechanism comprising: a base; a glide bracket coupled to the base; a front glide link having an upper end and a lower end, the upper end of the front glide link being pivotally coupled to the glide bracket; a rear glide link having an upper end and a lower end, the upper end of the front glide link being pivotally coupled to the glide bracket; a recline mechanism having a plurality of interconnected links, the recline mechanism coupled to the lower end of the front glide link and the rear glide link, the interconnected links of the recline mechanism including: a back bracket coupled to the recline mechanism; a seat plate coupled to the recline mechanism; an ottoman linkage coupled to the recline mechanism; a carrier link, and wherein the lower end of the rear glide link is directly, pivotally coupled to the carrier link, and the lower end of the front glide link is indirectly, pivotally coupled to the carrier link; and a rear pivot link pivotally coupled to the carrier link and the seat plate; the recline mechanism operable to move the glider recliner mechanism from a closed position, with the ottoman linkage stowed, to an extended position with the ottoman linkage extended in front of the seat plate, and to a fully reclined position with the ottoman linkage extended in front of the seat plate, the seat plate reclined from front to back and the back bracket reclined from an upright position; wherein the pivot point of the rear pivot link and the carrier link serves as a recline pivot point about which the mechanism rotates when moving from the extended position to the fully reclined position, and wherein the recline pivot point is located below the rear of the seat plate.

Clause 17: The glider recliner mechanism of clause 16, wherein the interconnected links of the recliner mechanism further comprise a glide pivot link pivotally coupled between the carrier link and the front glide link.

Clause 18: The glider recliner mechanism of any of clauses 16-17, wherein the rear pivot link rotates forwardly as the recline mechanism moves the glider recliner mechanism from the closed position to the extended position.

Clause 19: The glider recliner mechanism of any of clauses 16-18, wherein the forward rotation of the rear pivot link translates the glide control link forwardly, moving the lower end of the front glide link forwardly, as the recline mechanism moves the glider recliner mechanism from the closed position to the extended position.

Clause 20: The glider recliner mechanism of any of clauses 16-19, wherein the lower end of the front glide link and the lower end of the rear glide link are a first distance apart with the glider recliner mechanism in the closed position, and wherein the lower end of the front glide link and the lower end of the rear glide link are a second distance apart with the glider recliner mechanism in the extended position, and wherein the second distance is greater than the first distance.

It should be noted that the above embodiments are merely illustrative, and the present invention is not limited to these embodiments. Upon consideration of the present specification, those skilled in the art can make various changes and modifications without departing from the scope or spirit of the present invention. The true scope of the present invention is determined by the claims and their equivalents.

What is claimed:

1. A glider recliner mechanism for use on a chair, the glider recliner mechanism comprising:

a base;

a glide bracket coupled to the base;

a front glide link having an upper end and a lower end, the upper end of the front glide link being pivotally coupled to the glide bracket;

a rear glide link having an upper end and a lower end, the upper end of the rear glide link being pivotally coupled to the glide bracket;

a recline mechanism having a plurality of interconnected links, the recline mechanism coupled to the lower end of the front glide link and the rear glide link;

a back bracket coupled to the recline mechanism;

a seat plate coupled to the recline mechanism;

an ottoman linkage coupled to the recline mechanism; and the recline mechanism operable to move the glider recliner mechanism from a closed position, with the ottoman linkage stowed, to an extended position with the ottoman linkage extended in front of the seat plate, and to a fully reclined position with the ottoman linkage extended in front of the seat plate, the seat plate reclined from front to back and the back bracket reclined from an upright position;

wherein the interconnected links of the recline mechanism move the lower end of the front glide link forwardly as the recline mechanism moves the glider recliner mechanism from the closed position to the extended position.

2. The glider recliner mechanism of claim 1, wherein the interconnected links of the recliner mechanism further comprise a carrier link, and wherein the lower end of the rear glide link is directly, pivotally coupled to the carrier link, and the lower end of the front glide link is indirectly, pivotally coupled to the carrier link.

3. The glider recliner mechanism of claim 2, wherein the interconnected links of the recliner mechanism further comprise a glide pivot link pivotally coupled between the carrier link and the front glide link.

4. The glider recliner mechanism of claim 3, wherein the interconnected links of the recliner mechanism further comprise:

a rear pivot link pivotally coupled to the carrier link and the seat plate; and a glide control link pivotally coupled to the rear pivot link on one end, and pivotally coupled to the glide pivot link on an other end;

wherein the rear pivot link rotates forwardly as the recline mechanism moves the glider recliner mechanism from the closed position to the extended position.

5. The glider recliner mechanism of claim 4, further comprising an inwardly extending stop pin fixedly coupled to the rear pivot link, wherein a lower portion of the back bracket abuts the stop pin when the glider recliner mechanism is in the fully reclined position.

6. The glider recliner mechanism of claim 4, wherein the forward rotation of the rear pivot link translates the glide control link forwardly, moving the lower end of the front glide link forwardly, as the recline mechanism moves the glider recliner mechanism from the closed position to the extended position.

7. The glider recliner mechanism of claim 6, wherein the forward rotation of the rear pivot link translates the seat plate forwardly as the recline mechanism moves the glider recliner mechanism from the closed position to the extended position.

8. The glider recliner mechanism of claim 4, wherein the seat plate, the back bracket and the ottoman linkage rotate about a pivot point between the rear pivot link and the carrier link as the glider mechanism moves from the extended position to the fully reclined position.

9. The glider recliner mechanism of claim 8, wherein the pivot point between the rear pivot link and the carrier link is located below and behind a lower corner of the seat plate.

10. The glider recliner mechanism of claim 2, wherein the lower end of the front glide link and the lower end of the rear glide link are a first distance apart with the glider recliner mechanism in the closed position, and wherein the lower end of the front glide link and the lower end of the rear glide link are a second distance apart with the glider recliner mechanism in the extended position, and wherein the second distance is greater than the first distance.

11. A glider recliner chair, comprising:

a base;

a glider recliner mechanism coupled to the base;

a seat plate coupled to the glider recliner mechanism;

a back coupled to the glider recliner mechanism;

an ottoman coupled to the glider recliner mechanism;

a pair of spaced apart arms coupled to the glider recliner mechanism; and the glider recliner mechanism operable to allow a gliding reciprocal motion of the seat plate with the chair in a closed position with an ottoman linkage stowed below the seat plate and the back generally upright, and operable to move the glider recliner chair from the closed position to an extended position with the ottoman extended in front of the seat plate and the back generally upright, and to a fully reclined position with the ottoman extended in front of the seat plate, the seat plate reclined from front to back and the back reclined from an upright position;

wherein the glider mechanism rotates the glider recliner chair about a recline pivot point located below and behind the back of the seat plate as the glider recliner chair moves from the extended position to the fully reclined position.

12. The glider recliner chair of claim 11, wherein the recline pivot point allows a lower, rearward most portion of each chair arm to be within one and one-half inches of an underlying support surface on which the glider recliner rests, when the glider recliner is moved to the fully reclined position.

13. The glider recliner chair of claim 12, wherein the seat plate, in the fully reclined position, is reclined at an angle above twenty degrees, relative to horizontal.

14. The glider recliner chair of claim 11, wherein the glider recliner mechanism moves the seat plate forwardly as the recliner chair moves from the closed position to the extended position.

15. The glider recliner chair of claim 14, wherein the glider recliner mechanism prevents the gliding reciprocal motion in the extended position and the fully reclined position.

16. A glider recliner mechanism for use on a chair, the glider recliner mechanism comprising:

a base;

a glide bracket coupled to the base;

a front glide link having an upper end and a lower end, the upper end of the front glide link being pivotally coupled to the glide bracket;

a rear glide link having an upper end and a lower end, the upper end of the rear glide link being pivotally coupled to the glide bracket;

a recline mechanism having a plurality of interconnected links, the recline mechanism coupled to the lower end of the front glide link and the rear glide link, the interconnected links of the recline mechanism including:

a back bracket coupled to the recline mechanism;

a seat plate coupled to the recline mechanism;

an ottoman linkage coupled to the recline mechanism;

a carrier link, and wherein the lower end of the rear glide link is directly, pivotally coupled to the carrier link, and the lower end of the front glide link is indirectly, pivotally coupled to the carrier link;

a rear pivot link pivotally coupled to the carrier link and the seat plate; and the recline mechanism operable to move the glider recliner mechanism from a closed position, with the ottoman linkage stowed, to an extended position with the ottoman linkage extended in front of the seat plate, and to a fully reclined position with the ottoman linkage extended in front of the seat plate, the seat plate reclined from front to back and the back bracket reclined from an upright position;

wherein a pivot point of the rear pivot link and the carrier link serves as a recline pivot point about which the mechanism rotates when moving from the extended position to the fully reclined position, and wherein the recline pivot point is located below and behind a back end of the seat plate.

17. The glider recliner mechanism of claim 16, wherein the interconnected links of the recliner mechanism further comprise a glide pivot link pivotally coupled between the carrier link and the front glide link.

18. The glider recliner mechanism of claim 17, wherein the rear pivot link rotates forwardly as the recline mechanism moves the glider recliner mechanism from the closed position to the extended position.

19. The glider recliner mechanism of claim 18, wherein the forward rotation of the rear pivot link translates a glide control link forwardly, moving the lower end of the front glide link forwardly, as the recline mechanism moves the glider recliner mechanism from the closed position to the extended position.

20. The glider recliner mechanism of claim 19, wherein the lower end of the front glide link and the lower end of the rear glide link are a first distance apart with the glider recliner mechanism in the closed position, and wherein the lower end of the front glide link and the lower end of the rear glide link are a second distance apart with the glider recliner mechanism in the extended position, and wherein the second distance is greater than the first distance.

* * * * *